United States Patent [19]

Dorenkamp et al.

[11] Patent Number: 4,478,195

[45] Date of Patent: Oct. 23, 1984

[54] FUEL INJECTION PUMP FOR INTERNAL COMBUSTION ENGINES

[75] Inventors: Richard Dorenkamp, Stuttgart; Werner Faupel, Gerlingen; Gerhard Geyer, Munich; Erich Jäger, Korb, all of Fed. Rep. of Germany

[73] Assignee: Robert Bosch GmbH, Stuttgart, Fed. Rep. of Germany

[21] Appl. No.: 379,803

[22] Filed: May 19, 1982

[30] Foreign Application Priority Data

May 27, 1981 [DE] Fed. Rep. of Germany ..... 3121108

[51] Int. Cl.[3] ..... F02M 59/20; F02M 59/32

[52] U.S. Cl. ..... 123/502; 123/449

[58] Field of Search ..... 123/502, 501, 500, 449

[56] References Cited

U.S. PATENT DOCUMENTS

| | | | |
|---|---|---|---|
| 3,314,406 | 4/1967 | Kemp | 123/502 |
| 4,262,645 | 4/1981 | Kobayashi | 123/502 |
| 4,359,995 | 12/1982 | Mowbray | 123/502 |
| 4,365,939 | 12/1982 | Skinner | 123/502 |
| 4,384,562 | 5/1983 | Hammock | 123/502 |

*Primary Examiner*—Charles J. Myhre
*Assistant Examiner*—Carl Stuart Miller
*Attorney, Agent, or Firm*—Edwin E. Greigg

[57] ABSTRACT

A fuel injection pump for internal combustion engines having an injection timing adjustment by means of a hydraulically actuated piston is proposed, the injection timing adjustment being loaded by two restoring springs. Between the two springs, which have different forces, there is a common spring support plate. The variable functional path of the springs is determined by means of a stop and a coupler member.

2 Claims, 5 Drawing Figures

FUEL INJECTION PUMP FOR INTERNAL COMBUSTION ENGINES

BACKGROUND OF THE INVENTION

The invention is based on a fuel injection pump for internal combustion engines having a cam drive effecting the supply movement of at least one pump piston, the cam drive having a relatively rotatable portion supported in a pump housing for adjustment of injection onset, an adjuster piston cooperating with the cam drive and subjected to the rpm-dependent pressure of a supply pump counter to the force of two restoring springs. In known fuel injection pumps of this kind, either both restoring springs function simultaneously over the entire rpm range, or the action of one spring is added to that of the other once the adjusting piston has traveled a certain portion of its stroke. In the first case, the selection of different characteristic curves for the springs results in an overall characteristic curve which flattens out in the upper rpm range; however, there are limits to this flattening. In the second case, postponing the functioning of the second spring results in a clearly defined break in the characteristic curve, although with the disadvantage that the only control sequences which are possible are those where initially, at low rpm (that is, until the second spring comes into engagement), relatively large relative rotations per change in the rpm are possible and subsequently only smaller relative rotations per rpm chamber. However, in many internal combustion engines it is necessary for the course of the characteristic curve for injection onset to be reversed; that is, the injection onset, beyond a specific rpm, should adjust more rapidly toward "early" per rpm change with increasing rpm than is desired in the same engine at lower rpm. The instant of injection onset has an increasingly important role, given increasingly stringent demands for smoothness of engine operation and for the nontoxicity of exhaust gases.

OBJECT AND SUMMARY OF THE INVENTION

The fuel injection pump according to the invention has the advantage over the prior art that one or the other course of the characteristic curve can be attained depending on the selection of force or rigidity of the springs. As a result, one and the same injection adjuster can be used for various engines merely by using different springs, even for an engine on which varying demands are made, such as for ease of gear changing, power in specific rpm ranges or emissions figures.

Further advantages and advantageous embodiments of the invention can be learned from the description of the drawings and from the dependent claim.

The invention will be better understood and further objects and advantages thereof will become more apparent from the ensuing detailed description of two preferred embodiments taken in conjunction with the drawings.

DESCRIPTION OF THE PREFERRED EMBODIMENTS

Figure 1:
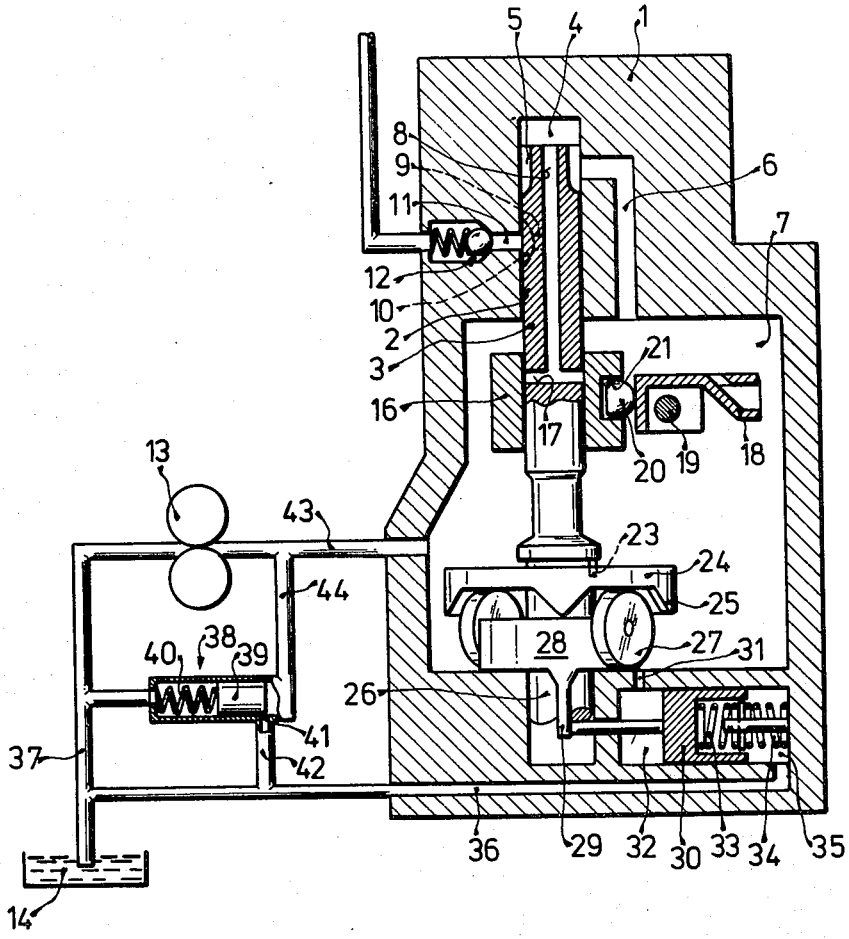
FIG. 1 is a simplified illustration partially in cross-section of a fuel injection pump with an injection timing adjuster.

FIG. 1 shows a fuel injection pump in simplified form and in longitudinal section. A pump piston 3 moves within a cylinder bore 2 in a housing 1, being set into a simultaneously reciprocating and rotating movement counter to the force of a restoring spring (not shown). The pump work chamber 4 of this pump is supplied with fuel from a suction chamber 7 via longitudinal grooves 5 disposed in the jacket face of the pump piston 3 and via a suction conduit 6 extending within the housing 1 so long as the pump piston is executing an intake stroke or assumes its bottom dead center position. As soon as the conduit 6 is closed upon the onset of the compression stroke and with a corresponding rotation of the pump piston 3, the fuel located in the pump work chamber 4 is directed via a longitudinal bore 8 extending in the pump piston and via a radial bore 9 branching off from the bore 8 to a longitudinal distributor groove 10 disposed in the jacket face of the pump piston (elements 9 and 10 are indicated with broken lines in the drawing). During a rotation of the pump piston 3, the distributor bore 10 opens up pressure lines 11 one after another, the number of these corresponding to the number of cylinders in the engine. The inlets of the pressure lines 11 are correspondingly distributed over the circumference of the cylinder bore 2; only two of the pressure lines 11 are shown in the drawing, one of them with broken lines. In each of these pressure lines 11, there is a check valve 12 which opens in the direction of fuel supply.

The suction chamber 7 is supplied with fuel from a fuel supply container 14 via a supply pump 13. The pump 13 is driven at a speed proportional to the engine rpm and is embodied as a volumetric pump, so that the supply quantity also increases with increasing rpm.

An annular slide 16 is disposed axially displaceably on the pump piston 3 and during the course of the compression stroke of the pump piston opens a radial bore 17 communicating with the longitudinal conduit 8, thus determining the end of supply or determining the quantity of fuel supplied by the pump piston to the pressure lines 11. The fuel flowing out following this opening of the radial bore 17 flows back into the suction chamber 7.

The annular slide is axially displaced via an intermediate lever 18, which is pivotable about a shaft 19 set firmly in the housing and at one end, with a head 20, engages a recess 21 of the annular slide 16. The other end of the intermediate lever 18 is engaged by a centrifugal governor (not shown), acting as an rpm signal transducer. This intermediate lever 18 is further engaged by a spring, whose initial stress is arbitrarily variable and which acts counter to the centrifugal force. The fuel injection quantity set by means of the axial position of the annular slide 16 is thus dependent on both the rpm and the arbitrarily set initial spring force (or load).

The pump and distributor piston 3 is connected via a pin 23 with a cam plate 24, on the underside of which are disposed end cams 25. The end cam plate 24 is connected in a rotationally engaged manner with a drive shaft 26, which is driven at an rpm which is synchronous with engine rpm. The end cam plate 24, 25 cooperates with rollers 27 of a roller ring 28 which is only relatively rotatable. When the drive shaft 26 and cam plate 24, 25 rotate, the pump and distributor piston 3 therefore executes a reciprocating movement in addition to its rotary movement. The number of cams 25 is selected such that the pump and distributor member executes precisely as many cycles per revolution of the cam plate as there are cylinders in the engine to be supplied by the injection pump. The roller ring 28 is supported in the housing 1 for its relative rotation and is connected via a bolt 29 with an injection adjuster piston 30 in such a manner that a displacement of the injection adjuster piston 30 causes the relative rotation of the roller ring 28. By means of this relative rotation of the rollers 27 with respect to the cams, the onset of supply and thus the compression stroke of the pump piston 3 is varied with respect to the angle of rotation of the drive shaft 26. A change in the injection onset thus takes place.

The injection adjuster piston 30 is acted upon by the rpm-dependent fuel pressure prevailing in the suction chamber 7, which is transmitted via a conduit 31 to one end face of the piston 30 and into a chamber 32. Depending on the level of this pressure—that is, depending on rpm—the piston 30 is displaced to a greater or lesser extent counter to the force of two restoring springs 33 and 34, causing a corresponding variation in the injection onset. The chamber 35 receiving the springs communicates via a relief conduit 36 with the fuel container 14 or the suction line 37 of the supply pump 13.

The control of the pressure in the pump suction chamber 7 is effected via a pressure control valve 38. This pressure control valve 38 operates with a regulating piston 39, which is displaceable by the supplied fuel counter to a restoring spring 40 and thereby opens a discharge opening 41 to a greater or lesser extent. From the discharge opening 41, a return flow conduit 42 leads back to the relief conduit 36 or to the suction line 37 of the supply pump 13. The supply pump 13, in turn, has a pressure line 43, which discharges into the suction chamber 7 and from which a control line 44 branches off, leading to the pressure control valve 38.

Figure 2:
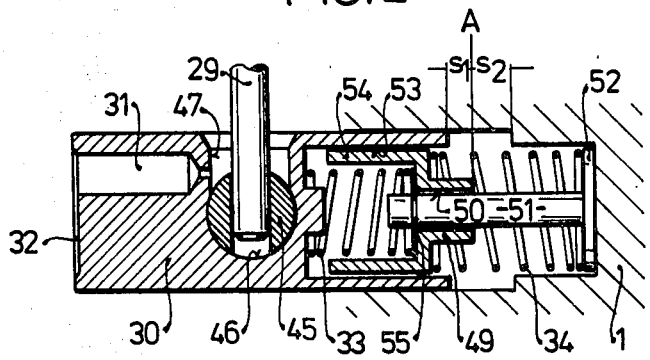
FIG. 2 shows the first exemplary embodiment, also in longitudinal section and on an enlarged scale.

In FIG. 2, a detail of the injection adjuster of FIG. 1 is shown on an enlarged scale and in terms of its structure. The coupler bolt 29 of the roller ring (not shown) is guided in an oscillatable element 45, which in turn is guided within a transverse bore 46 of the adjuster piston 30. Upon a stroke movement of the adjuster piston 30, the universal joint thus formed causes a pivoting movement on the part of the bolt 29 and thus a relative rotation of the roller ring 28. In order to make the pivoting movement of the bolt 29 possible, a blind bore 47 is provided, perpendicular to the axis of the piston, its diameter being smaller than that of the transverse bore 46 but substantially larger than the diameter of the bolt 29. This blind bore 47 naturally communicates with the suction chamber 7 of the injection pump. The conduit 31 then leads parallel to the piston axis from this blind bore 47 to the chamber 32.

The adjuster piston 30 is loaded on the side remote from the chamber 32 by the two springs 33 and 34, between which there is a common spring support plate 49. This spring support plate 49 is disposed in an axially displaceable manner on a shaft 51 via a central bore 50. The shaft 51 has a base plate 52 which is pressed by the spring 34 against a corresponding face of the housing 1, thereby fixing the shaft 51 in position. For its axial movement, the spring support plate 49 is guided radially in a blind bore 53 of the adjuster piston 30. A cup-shaped extension 54 is also provided on the spring plate 49, and substantially receives the spring 33. The spring support plate 49 is limited in its axial displaceability in the direction toward the adjuster piston 30 by a fastening ring 55, which engages a constricted area on the shaft 51.

Figure 3:
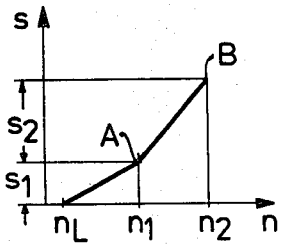
FIG. 3 is a diagram showing the adjustment in injection onset per rpm change.
Figure 4:
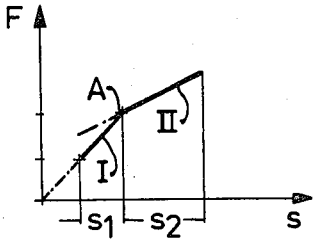
FIG. 4 is a diagram of the corresponding characteristic curves of the springs (spring force F plotted over the path s)

The function of the injection adjuster detail shown in FIG. 2 will now be illustrated with the aid of FIGS. 3 and 4. In FIG. 3, the stroke s of the injection adjuster piston is plotted on the ordinate and the engine rpm, corresponding to the fuel pressure in the suction chamber or in the chamber 32, is plotted on the abscissa. In FIG. 4, the spring force F is plotted on the ordinate and the stroke s of the adjuster piston 30 is plotted on the abscissa. As soon after the attainment of a predetermined rpm as a sufficiently high fuel pressure has built up in chamber 32, the adjuster piston 30 is displaced counter to the spring 33, until it has covered the path $s_1$. After covering this distance, the adjuster piston 30 strikes the cup-shaped extension 54 of the spring plate 49. As may be seen from the injection adjustment diagram of FIG. 3, point A is accordingly reached at rpm $n_1$. In the diagram for the characteristic curves of the springs in FIG. 4, only the spring 33 is compressed for the duration of the path $s_1$, which is represented by curve I. Since spring 33 is put into action with a certain degree of initial stress, and since, as seen in FIG. 3, the piston stroke does not begin with the rpm at zero but rather begins at an initial rpm $n_L$, the spring curve I in FIG. 4 is shown extended toward the point of origin. The second spring 34 is also used with initial stressing, in fact as described above by means of the fastening ring 55. Now, as soon as the rpm has increased beyond the rpm $n_1$, the spring support plate 49 is carried along in a positively engaged manner by the injection adjuster piston 30 and is displaced counter to the spring 34. In the illustrated example, a longer path $s_2$ is provided for the spring 34, with an approximately equally large increase in rpm, that is, from $n_1$ to $n_2$, as occurred previously between $n_L$ and $n_1$. The course of the injection adjustment curve from A to B is thus correspondingly more steeply inclined. This means that the spring 33 must have greater rigidity than spring 34. Contrastingly, curve II for spring 34 in the spring characteristic curve diagram of FIG. 4 is not as steeply inclined as curve I of spring 33 because of the lesser rigidity of spring 34. The breaks in the curves are at point A, that is, at the end of path $s_1$ and the beginning of path $s_2$. The spring rigidity is defined as a variation in force per change in path, with a linear spring curve having been selected in this case.

Depending on requirements, however, the spring rigidity of spring 34 may also be selected to be greater than that of spring 33. In that case, curve II of spring 34 would be more steeply inclined than curve I of spring 33. If, as in the exemplary embodiment shown, the path $s_2$ were selected to be a great deal longer than path $s_1$, then a substantially greater pressure variation in the fuel pressure would be required between rpm $n_1$ and $n_2$ than is the case in the illustrated embodiment.

Figure 5:
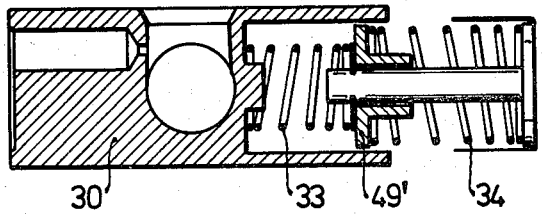
FIG. 5 shows the second exemplary embodiment, again in longitudinal section and on an enlarged scale.

In the second exemplary embodiment shown in FIG. 5, the only change is that the cup-shaped extension 54 is omitted from the spring plate 49', so that point A in the curves of FIGS. 3 and 4 has to be attained by means of very precise adaptation of the rigidity of spring 33 to that of spring 34. Spring 33 is thus effective from point A on, and is not out of engagement entirely for a period as is the case in the first exemplary embodiment.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. A fuel injection pump for internal combustion engines having a cam drive effecting the supply movement of at least one pump piston, said cam drive having a relatively rotatable portion supported in a pump housing for adjustment of injection onset, an adjuster piston cooperating with said cam drive and subjected to the rpm-dependent pressure of a supply pump counter to the force of two restoring springs, characterized in that said springs have different spring constants, that a common spring support plate is disposed between said two restoring springs, one of said last named springs being supported on said adjuster piston and the other of said springs being supported on said housing, said common spring support plate further includes a radial guide means and that the path of travel of said radial guide means is limited in one direction by a stop means disposed on said guide means, said adjuster piston executes a predetermined stroke and said spring support plate is displaceable in the same direction by a coupler means engaging said adjuster piston after having executed said predetermined stroke, said guide means further includes a shaft means which protrudes through a bore in the common spring support plate and is connected with said pump housing, said shaft is provided with said stop means and one of said springs having a greater initial force than the other being disposed between said spring support plate and said housing, and the other of said springs having a greater stiffness than said one of said springs.

2. A fuel injection pump as defined by claim 1, characterized in that said shaft means is disposed on a base plate, said base plate being pressed by one of said springs against a wall of said pump housing.

* * * * *